US006052871A

United States Patent [19]

Patelli et al.

[11] Patent Number: 6,052,871

[45] Date of Patent: Apr. 25, 2000

[54] DEVICE AND METHOD FOR CLEANING THE COVERINGS OF THE MOBILE FLATS IN A FLAT CARDER

[75] Inventors: Silvano Patelli; Giovanni Battista Pasini, both of Palazzolo Sull'Oglio, Italy

[73] Assignee: Marzoli S.p.A., Brescia, Italy

[21] Appl. No.: 09/249,270

[22] Filed: Feb. 12, 1999

[30] Foreign Application Priority Data

Feb. 16, 1998 [IT] Italy ..... MI98A0287

[51] Int. Cl.[7] ..... D01G 15/76

[52] U.S. Cl. ..... 19/109; 19/107; 19/111; 15/256.53; 15/312.1

[58] Field of Search ..... 19/109, 102, 104, 19/107, 110, 111, 98, 108, 218, 115 B, 263; 15/312.1, 256.53

[56] References Cited

U.S. PATENT DOCUMENTS

| | | | |
|---|---|---|---|
| 3,376,610 | 4/1968 | Williams | 19/107 |
| 4,368,561 | 1/1983 | Trutzchler . | |
| 4,759,102 | 7/1988 | Verzilli et al. | 19/111 |
| 4,996,746 | 3/1991 | Verzilli et al. | 19/111 |

*Primary Examiner*—John J. Calvert
*Assistant Examiner*—Gary L. Welch
*Attorney, Agent, or Firm*—Kramer Levin Naftalis & Frankel LLP

[57] ABSTRACT

Device for cleaning the coverings of the mobile flats in a flat carder, consisting of a rotary brush which is parallel to the to the cards, provided with mobile cleaning equipment, comprising a toothed rake which moves transversely to the brush, and a fixed suction nozzle for the material captured by the rake.

10 Claims, 3 Drawing Sheets

DEVICE AND METHOD FOR CLEANING THE COVERINGS OF THE MOBILE FLATS IN A FLAT CARDER

The present invention relates to sliding flat carders, in which a thin layer of fibrous material is worked by a series of surfaces which are provided with a plurality of tips which have various shapes, inclinations and rigidities, and are actuated by motion relative to one another, in which the fibrous material is opened in the form of individual fibres; the smallest particles of dirt are eliminated, as are waste and tangles, the fibres are mingled with one another and form a strip of non-twisted fibres, to be forwarded to the subsequent processing steps.

Figure 1:
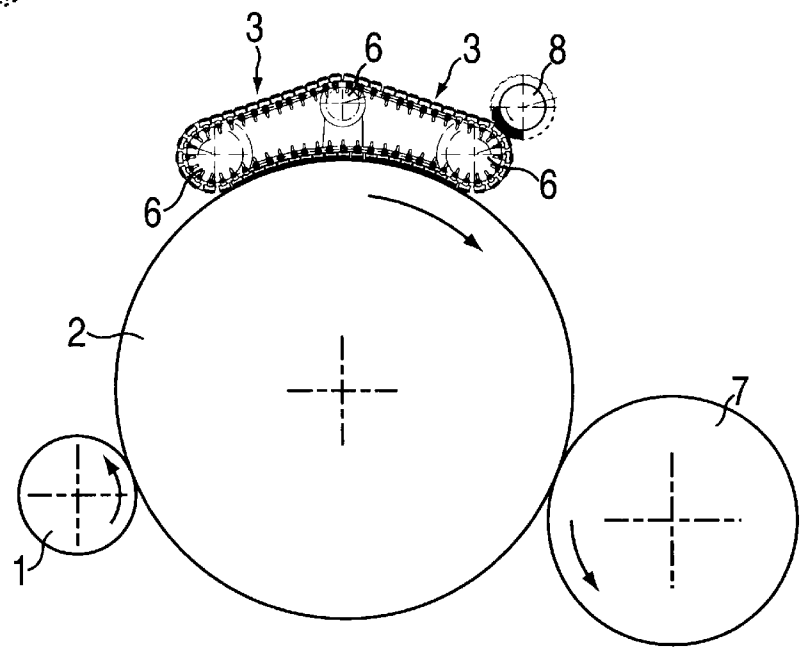
FIG. 1 PRIOR ART

In order to make apparent the technical problems which are involved in the operation of carding, and which are eliminated by the present invention, the flat carding method is described briefly hereinafter with reference to FIG. 1.

The unprocessed material, consisting of flock fibres in the form of a mat with a cross-section which is approximately rectangular, is first of all worked by an opening roller or crusher 1. This roller is provided with a covering i.e. with tips which are inclined in the direction of motion, and is actuated at a considerable speed of rotation; the layer of fibres is combed roughly and distributed on the said opening cylinder 1. As it is being rotated in an anti-clockwise direction, the layer of fibres encounters covered segments and blades to remove impurities, and the fibres are then transferred to the subsequent main carding drum 2.

The main drum is activated at a speed of rotation which is lower than that of the crusher 1, but, since its diameter is considerably larger, it moves at a higher peripheral speed. The main drum is also provided with a covering, the tips of which are inclined in the direction of motion, and remove the fibres from the surface of the crusher.

Above the upper part of the drum 2, the mobile flats 3 are disposed. These mobile flats are bars which have a useful length which corresponds to the generatrix of the main carding drum, and are a few centimetres wide. The part which faces the drum is provided with a covering 4 of tips, which are inclined like the covering tips of the drum. In general, the mobile flats 3 move slowly, and in a direction of rotation which is the same as, or opposite that of the drum: the respective coverings cooperate with typical carding action, with the effects of stretching and cleaning the fibres, and restraining and controlling the sinking of the fibres inside the covering of tips. The peripheral speed of the drum is in general within the range of 15–40 metres per second, whereas the speed of the flats is approximately a few millimetres per second.

The flats 3 circulate around the periphery of the drum, conveyed by a traction unit, in general chains 5 or toothed belts, which circulate between toothed guide or drive wheels 6.

The fibres which are worked on the drum 2 are then detached by a discharge cylinder or offer 7, which is also provided with tips which are inclined in the direction of rotation, and permit removal of the carded fibres from the drum 2. From the doffer the fibres are collected by detachment cylinders which are not shown in the figure.

The present invention relates to treatment of the sliding flats 3, and in particular to cleaning of their covering 4. In fact, in this covering there accumulate tangles of fibres, which also retain some of the impurities removed from the fibres worked on the main drum, and stretched fibre s which have become disengaged from the covering of the drum itself. In this condition the covering of mobile flats becomes clogged, such that their own efficiency of carding with the drum is decreased. As a result of the dirtying of the covering of the flats, the quality of the strip of fibres produced by the carder deteriorates rapidly.

Figure 1A:
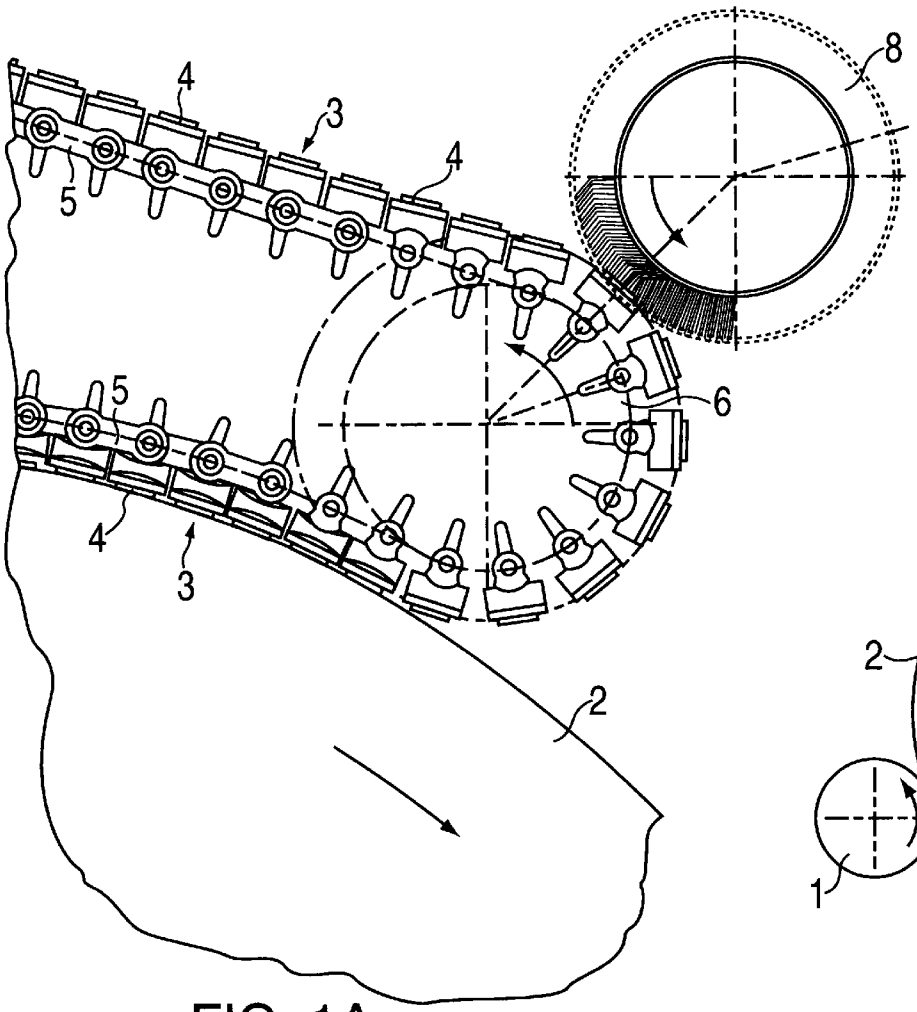
FIG. 1A PRIOR ART

In the known art, for example as described in U.S. Pat. No. 4,368,561, the mobile flats of the carder are subjected to continual action of cleaning with a rotary brush, which comes into contact with the covering of the flats in their upper, inactive section, generally in the position of one of the drive and guide wheels 6, at the start or end of their upper, inactive path. In FIG. 1A, this rotary brush 8 is shown in the position of the right-hand toothed wheel 6; it is provided with bristles which penetrate the covering of the flats.

The dirt and fibres thus removed from the covering of the flats are transferred to the brush, which in turn must have this material removed from it, in order to prevent excessive accumulation which would quickly clog the rotary brush, and render its action inefficient or even ineffectual. In addition to this disadvantage, when the brush is saturated with dirt, it must be taken into account that this material which is removed from the covering in rotation, is no longer retained by the brush, and is dispersed in the surrounding environment, such that re-depositing on the covering of the flats which follow can occur.

In the known art, such as in the aforementioned U.S. Pat. No. 4,368,561, this brush is connected to an adjacent thresher comb, which has no contact with the brush, and is contained in an aperture delimited by walls. This thresher comb is actuated at a high rotational speed, and, substantially by means of a fan effect, it clears from the brush the material which the latter has taken the flats, which material travels through the passage between the walls and the rotary comb, and is deposited in a box, which is provided at the base of a longitudinal suction nozzle for discharge of the material.

This technical solution is complex, and is not problem-free; in order to ensure that the quality of the strip produced is good, frequent manual interventions are necessary both on the rotary brush and on the thresher comb, resulting in a significant reduction of the service factor of the production line.

The object of the present invention is to provide an improved system and device for cleaning the coverings of the flats of the said flat carders, without the disadvantages of the systems according to the known art. A further object of the present invention is to provide a system for cleaning the coverings of the flats, which permits control of the material removed from the rotary brush, without dispersing the material in the surrounding environment.

The present invention provides a device for cleaning the coverings of the mobile flats in a flat carder, comprising a rotary brush which has an axis parallel to the axis of the main drum of the carder, and is disposed in part of the inactive path of the mobile flats, in order to remove the fibers or dirt retained on the coverings, wherein the carder is provided with mobile equipment for cleaning the brush, which moves transversely along the generatrix of the brush, for the entire length of the carder.

In order to illustrate more clearly the characteristics and advantages of the present invention, it is described with reference to some of its typical embodiments, shown in FIGS. 2 to 3, by way of non-limiting example.

Figures 2A, 2B:
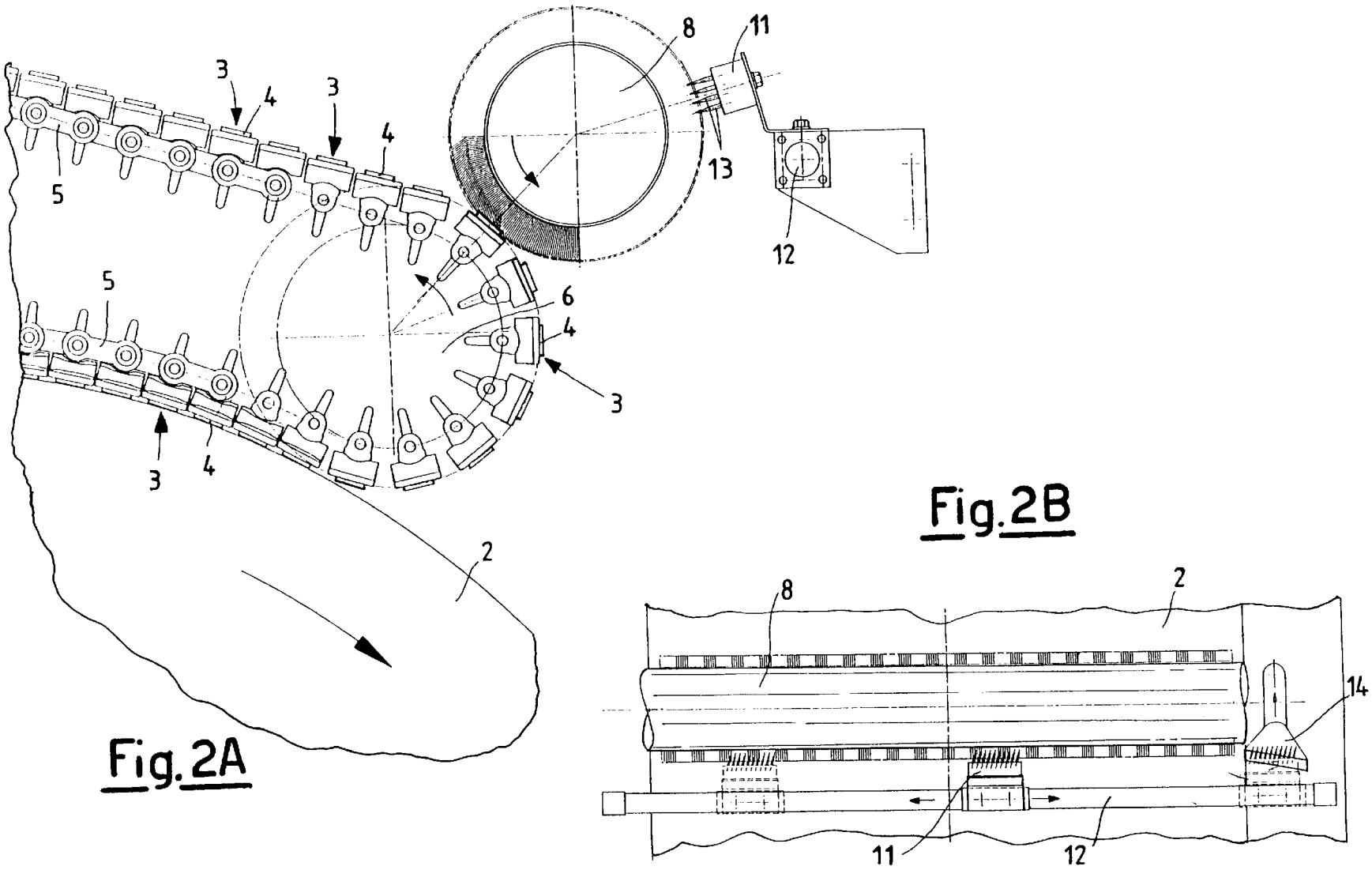

FIGS. 2A,B illustrate a typical embodiment of the system according to the invention, for cleaning of flats. FIG. 2A shows a lateral view of the device for treatment of the coverings of the flats, and FIG. 2B shows a front view of the device.

The flats 3 move in an anti-clockwise direction, and concurrently with the rotation of the main drum 2, as it presents its own covering 4, at a speed of 100–500 mm per minute, to the cleaning action of the rotary brush 8, which is disposed with its axis parallel to the axis of the main drum 2 of the carder. Typically, this brush has a cylindrical shape, which is as long as the generatrix of the main drum of the carder, and has a diameter of 150–300 and preferably approximately 200 mm, and is rotated at a moderate speed of 2–15 revolutions per minute, and preferably 4–8 revolutions per minute. This brush is provided with flexible bristles which separate the fibres, and reach as far as the vicinity of the base of the covering of the flats, for example up to 1–3 mm away from the latter. Its action is graduated in order both to remove the material satisfactorily from the flats, and retain it efficiently on the brush itself. The material which is removed from the flats and retained on the brush 8, is removed continually by mobile equipment, which, in its embodiment according to FIGS. 2A,B, consists of a transverse rake 11 which moves along the generatrix of the brush 8, guided by a bar 12, for the entire width of the carder 2. The rake 11 consists of teeth 13 which penetrate in the thickness of the layer of bristles of the brush 8 as far as the vicinity of their base. The covering of the rake consists of teeth which are substantially cylindrical, with a density of 5–15 teeth per $cm^2$, and a length of 5–50 mm. Altogether, the number of teeth which constitute the rake is in the range of 30–90 teeth The rake 11 is actuated to explore with forward and rearward motion the entire length of the brush 8, with drive means which are conventional, for example which consist of a control rod connected to a pneumatic double-acting cylinder, with a frequency of 10–50 courses per minute, i.e. 5–25 forward and rearward cycles per minute, and preferably 10–15 cycles per minute.

At at least one of the two ends of the course of the rake on the guide bar 13, there is disposed a fixed suction nozzle 14, to which the rake is presented in each forward and rearward cycle. The nozzle 14 preferably has an aperture with a shape such as to receive the rake 11 in its step of inversion of the direction of motion, and the rake penetrates with its teeth at least partially inside the nozzle, such that the suction action of the latter substantially clears from the teeth of the rake the material which has been removed from the brush 8 in the preceding cycle. In FIG. 2B, the rake 11 is shown in the form of broken lines at the right-hand end of travel, in the position of the nozzle 14, and its teeth are shown inserted well inside the aperture of the nozzle. According to a preferred embodiment of the invention, the teeth 13 are oriented with slight inclination, of 5° to 25°, relative to the direction at right-angles to the motion of the rake, towards the nozzle. The values of the suction pressure are preferably maintained in the range of 20–80 mm of $H_2O$.

Figure 3A:
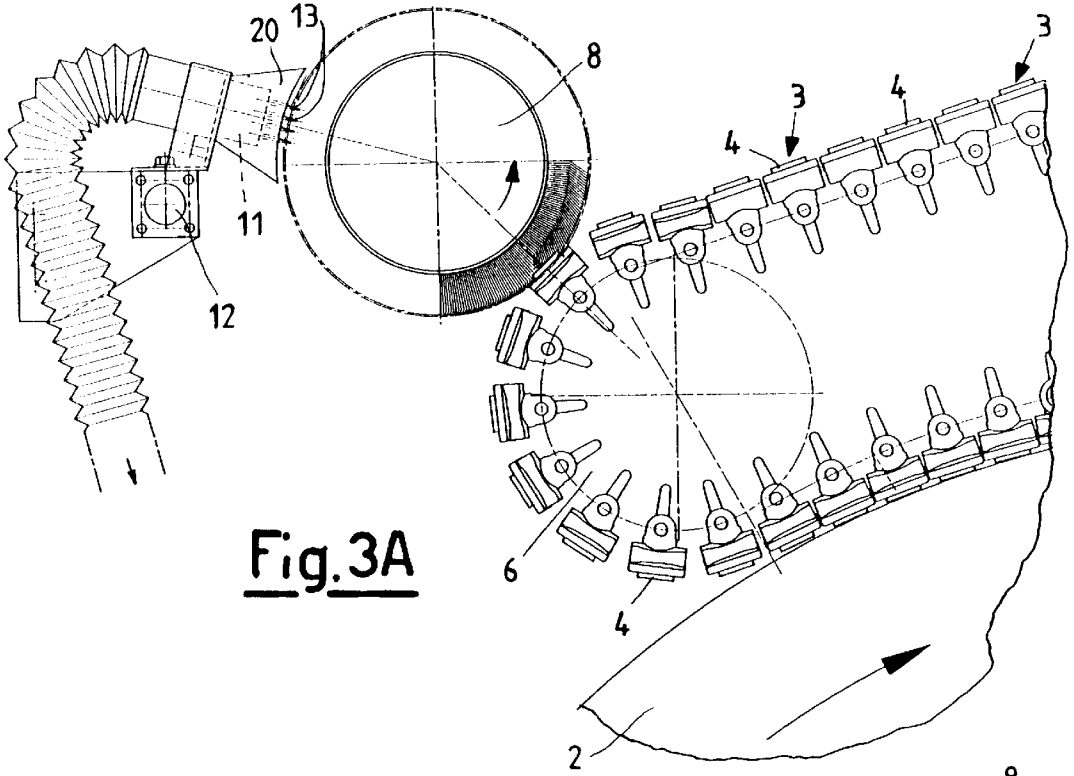
Figure 3B:
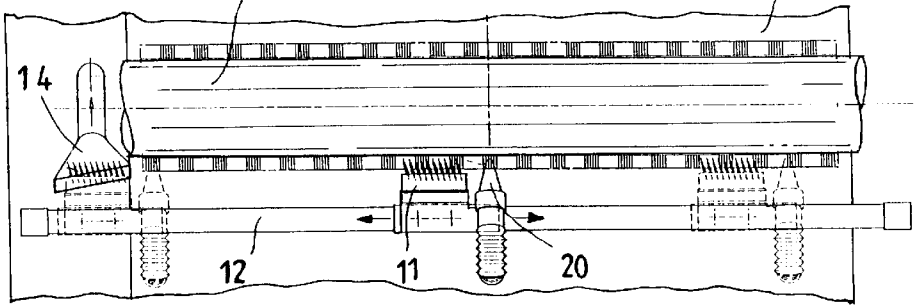

In the embodiment shown in FIGS. 3A,B, a variant of the system described with reference to FIGS. 2A,B is shown. In FIGS. 3A,B, the system for cleaning the coverings of the flats is shown in the position of the left-hand guide and drive wheel 6 for the mobile flats. In these figures, the equipment which travels in the direction transverse to the brush 8 does not consist simply of the rake 11, and is completed by one or a plurality of suction nozzles 20, which travel together with the rake 11. In FIG. 3B, the rake 11 is shown in the form of broken lines at the end of the left-hand travel, in the position of the fixed nozzle, inside which, in this case also, its teeth 13 are inserted for suction, well within the aperture of the nozzle. The travelling nozzle 20 is disposed such as to explore the outer surface of the brush 8, without penetrating the layer of bristles. The suction pressure values already indicated for the fixed nozzle 14 also apply for the travelling nozzle 20.

This embodiment makes it possible to improve the effect of cleaning of the brush 8, since a significant quantity of its material is removed directly by the nozzle 20; in general, this material is the finest material, such as dust, dirt, and very short fibres. The material which is retained by the teeth of the rake 11 thus contains a greater quantity of fibres of a specific length, and can also be re-used, by separating the suction systems of the fixed nozzle 14 and the travelling nozzle 20.

The embodiment according to FIGS. 3A,B can be used substantially when it is advantageous to remove from the cycle the finest material, without fitting, or keeping inactive, both the rake 11 and the fixed nozzle 14, and making the travelling nozzle 20 alone responsible for the action of discharging the material retained by the brush 8.

The system according to the present invention, for cleaning of coverings, has substantial advantages compared with those of the known art, including at least the following effects which deserve mention.

The present system permits highly efficient continual cleaning, thus making it possible to space over a period of time the manual maintenance interventions on the flats and on the rotary brushes, and to increase the service factor of the carder. These flats must be removed one at a time, and owing to the large number of flats installed for each carder, it can be appreciated that it is advantageous to be able to reduce this maintenance requirement.

The strip produced by the carder is of better quality, as a result of better cleaning of the coverings of the mobile flats. Simultaneously it is possible to use higher speeds for the mobile flats, and thus to obtain greater regularity of the product.

In the embodiment in FIGS. 3A,B, the material which is retained by the coverings of the flats can be removed by classifying the material itself into a fraction of dirt, and a fraction of waste fibres which can be recycled in processing.

We claim:

1. An assembly for cleaning mobile flat covers in a flat carding machine comprising:

a rotary brush subassembly for removing debris from mobile flat covers;

a mobile equipment subassembly for cleaning the rotary brush subassembly, said mobile equipment subassembly comprising a rake with teeth, wherein said rake with teeth is adapted to move in a reciprocal forward and rearward direction transversely across the rotary brush subassembly; and at least one suction nozzle for removing debris from the rotary brush subassembly, said at least one suction nozzle disposed at one end of the forward and rearward motion of the mobile equipment subassembly.

2. The assembly of claim 1, wherein the teeth are disposed on the rake at an angle toward the suction nozzle at a range from approximately 5 degrees to approximately 25 degrees relative to the direction of the motion of the rake.

3. The assembly of claim 1, wherein the teeth are substantially cylindrical, having a density of approximately 5 to approximately 15 teeth per square cm, and a length of approxirnately 5 to approximately 50 mm.

4. The assembly of claim 1, wherein the number of teeth disposed on the rake is between approximately 30 and approximately 90.

5. An assembly for cleaning mobile flat covers in a flat carding machine comprising:

a rotary brush subassembly for removing debris from mobile flat covers;

a mobile equipment subassembly for cleaning the rotary brush subassembly, said mobile equipment subassembly comprising a rake with teeth, wherein said rake with teeth is adapted to move in a reciprocal forward and rearward direction transversely across the rotary brush subassembly; and at least one suction nozzle for removing debris from the rotary brush subassembly, said at least one suction nozzle adapted to travel across the surface of the rotary brush subassembly in substantial communication with the mobile equipment subassembly.

6. The assembly of claim 5, wherein the mobile equipment is actuated with a frequency of approximately 5 to approximately 25 forward and rearward cycles per minute.

7. The assembly of claim 6, wherein suction pressure values within the suction nozzle are maintained within a range of approximately 20 to approximately 80 mm of $H_2O$.

8. The assembly of claim 7, wherein debris removed from the mobile flat covers is separated into a fraction of dirt and a fraction of fibers.

9. The assembly of claim 8, wherein said fraction of dirt is discarded and said fraction of fibers is saved to be recycled.

10. The assembly of claim 5, wherein the mobile equipment is actuated with a frequency of approximately 10 to approximately 15 cycles per minute.

* * * * *